United States Patent [19]

Jäger

[11] 4,211,641

[45] Jul. 8, 1980

[54] CIRCULATING AIR CLASSIFIER OR SEPARATOR

[76] Inventor: Heinz Jäger, Nevelstrasse 40, 4630 Bochum 1, Fed. Rep. of Germany

[21] Appl. No.: 955,623

[22] Filed: Oct. 27, 1978

[30] Foreign Application Priority Data

Oct. 28, 1977 [DE] Fed. Rep. of Germany ..... 2748336

[51] Int. Cl.[2] ..... B04C 5/30

[52] U.S. Cl. ..... 209/144; 209/154; 209/146

[58] Field of Search ..... 209/139 A, 11, 146, 209/148, 154, 139 R, 144, 12, 147; 55/431, 459 R

[56] References Cited

U.S. PATENT DOCUMENTS

| | | | |
|---|---|---|---|
| 1,504,280 | 8/1924 | Stebbins | 209/144 |
| 1,912,910 | 6/1933 | Neuman et al. | 209/139 R |
| 1,962,455 | 6/1934 | Montgomery | 209/139 A |
| 2,616,563 | 11/1952 | Hebb | 209/144 |
| 2,708,033 | 5/1955 | Thomas | 209/144 |
| 2,968,401 | 1/1961 | Sheldon | 209/144 |
| 3,095,369 | 6/1963 | Jäger | 209/139 R |
| 3,535,854 | 10/1970 | Taylor | 55/459 R |
| 3,667,600 | 6/1972 | Oi et al. | 209/144 |

*Attorney, Agent, or Firm*—Hebert L. Lerner
*Primary Examiner*—Tim R. Miles

[57] ABSTRACT

Circulating air classifier having a separator chamber containing an impeller rotatable about a vertical axis, and a funnel-shaped pre-separator disposed underneath and in open communication with the separator chamber. A blower forces air through a conduit. Material to be classified is fed into the air through an inlet in the conduit. The feed material and air enter the upper part of the pre-separator tangentially causing pre-separation, i.e. some coarse matter to separate. The air with the remaining feed material passes upwardly into the separator chamber wherein aided by the impeller further separation of coarse matter takes place. The air with the suspended fine material passes out of the separator chamber into cyclones wherein the fine material is separated from the air. The thus cleansed air is recirculated to the suction side of the blower.

4 Claims, 4 Drawing Figures

CIRCULATING AIR CLASSIFIER OR SEPARATOR

BACKGROUND OF THE INVENTION

1. Field of the Invention

This invention relates to air classifiers for separating coarse and fine fractions of solid material and more particularly refers to a new and improved circulating air classifier with vertical axis in which the air blower is located outside the classifier separator and air containing fine material is transferred from the classifier separator to separating cyclones and the cleansed air recirculated to the blower.

2. Description of the Prior Art

A vertical axis air classifier is one in which the rotating components are carried on a vertical shaft. In a circulating air classifier with vertical axis, the sifting or classifier air is moved by a blower outside the separator housing. The material to be separated is fed to a rotating spreading disc within the separator chamber, which throws the material to be separated into the separator chamber and thereby spreads it uniformly in veil-fashion over the entire separator area, so that the air stream helically rising in the separator chamber can seize the dust to be separated as completely as possible and remove it from the separator chamber. Under the influence of centrifugal and gravity forces, the coarse matter leaves the separator chamber in a downward direction via a collecting funnel.

In this classifier, all the material to be separated is conducted into the separator chamber. This is a disadvantage particularly if the material to be separated has percentagewise fewer fine components than coarser material. As a result, the separator chamber is unnecessarily loaded, whereby the efficiency of the separation process is adversely affected. Thus, it is most difficult if not impossible to separate the coarse matter sharply from finer material in the feed material undergoing classification. This factor of sharp separation of the coarse matter, however, is important for the production of flour-free grit, if the latter is to be returned to a mill for further grinding. The coarser grains also cause heavy wear at the spreading disc and at the blades of the centrifugal system arranged above the spreading disc.

SUMMARY OF THE INVENTION

An object of the present invention is to provide a circulating air classifier with vertical axis which will efficiently effect sharp separation of coarse matter from fine material in the feed material.

With the foregoing and other objects in view, there is provided in accordance with the invention a circulating air classifier with vertical axis having (a) a separator chamber in which coarse matter is separated from fine material, (b) an impeller rotatable about the vertical axis disposed in the separator chamber to aid in separating the coarse matter from the fine material suspended in air rising up through the separator chamber, (c) an opening in the bottom of the separator chamber through which the coarse matter discharges, (d) at least another opening in the separator chamber above the bottom through which the fine material suspended in air is discharged, (e) at least one cyclone for receiving said fine material suspended in air and separating the fine material from the air, (f) connecting means for conducting the fine material suspended in air from the opening in the separator chamber to the cyclone, (g) an air blower with an air suction inlet and a pressure discharge outlet, (h) an air return line connecting the cyclone to the suction inlet for recirculating air separated in the cyclone, (i) a funnel-shaped pre-separator chamber disposed underneath and in open communication with the separator chamber, (j) a compressed air-line with one end connected to the pressure discharge outlet of the air blower and the other end opening into the upper part of the funnel-shaped pre-separator with air from the air-line flowing tangentially into the pre-separator, (k) inlet means in the compressed air-line upstream from the funnel-shaped pre-separator for the introduction of feed matter, which together with air flowing from the air blower enters the pre-separator tangentially causing coarse matter to be separated from the feed matter, and (l) outlet means in the lower part of the pre-separator for the discharge of the coarse matter.

Other features which are considered as characteristic for the invention are set forth in the appended claims.

Although the invention is illustrated and described herein as embodied in a circulating air classifier or separator, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
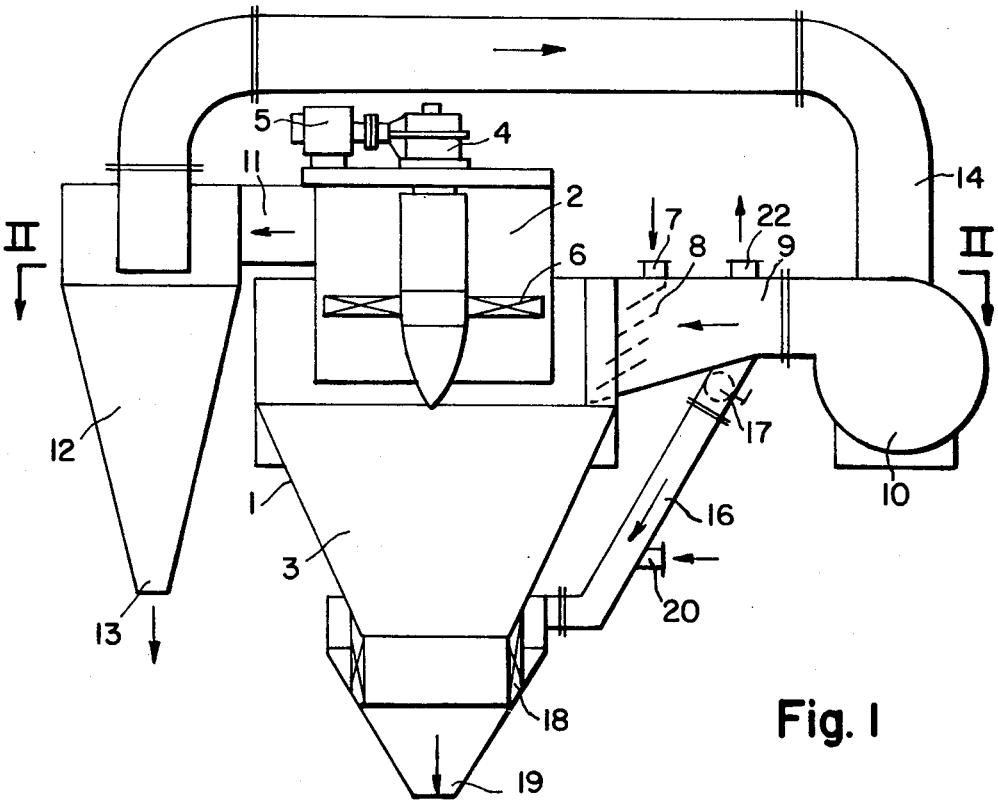
FIG. 1 is an elevational view of a circulating air classifier in accordance with the invention taken along the line I—I of FIG. 2 in the direction of the arrows.

In accordance with the invention, it is important that the compressed-air line coming from the blower leads tangentially into the upper part of the collecting funnel or pre-separation chamber and that the material to be separated is fed into this pressure line, optionally via a distribution device. This relieves the separator chamber above the pre-separating chamber of handling all the feed material, and since the quantity of material passing through the separator chamber is substantially reduced, the separating effect is substantially increased thereby. It is also possible to separate fractions (fine, medium and coarse product) with this air separator.

In a further embodiment of the invention, a post-separator chamber for coarser material discharged on the collecting funnel may be arranged underneath the collecting funnel. This post-separator is supplied with sifting or classifier air by way of a branch line of the blower pressure line thereby stripping fine material from the coarser material discharged on the collecting funnel and making for sharp separation. The coarse matter can also be collected from the separator chamber in a separate funnel within the collecting funnel and the coarse matter collected in the separate funnel and removed separately.

In the drawings, the invention is depicted in two embodiment examples.

Figure 2:
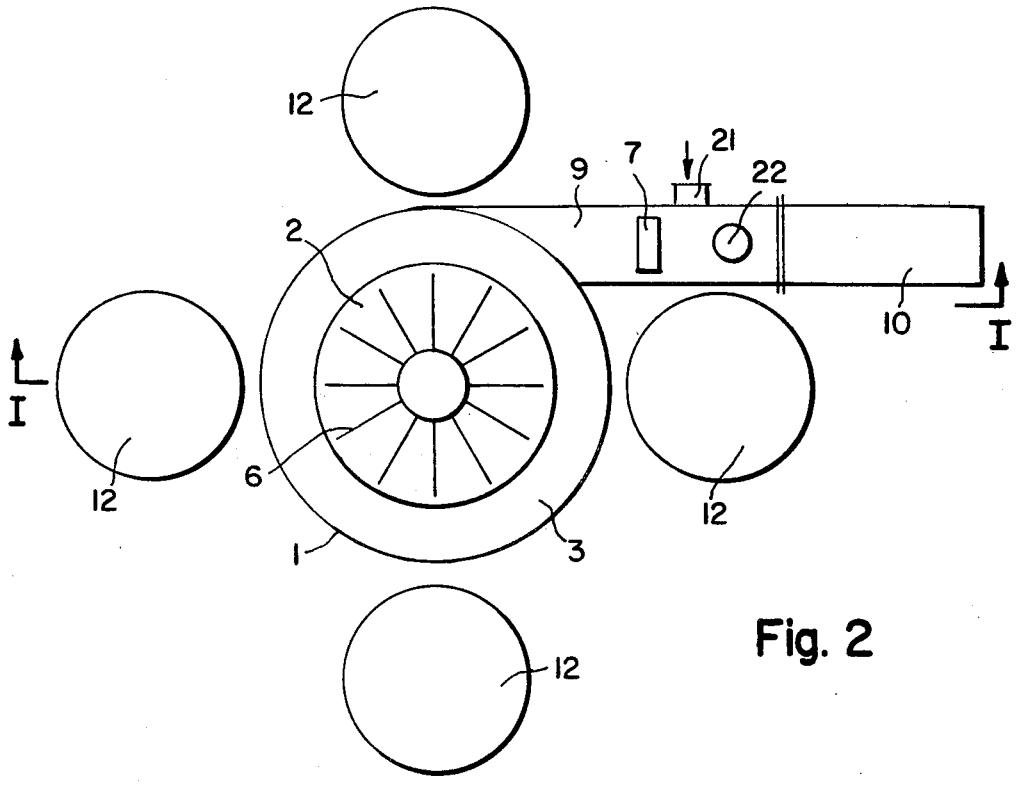
FIG. 2 is a top view of FIG. 1 taken along the line II—II of FIG. 1.

The separator housing 1 in FIGS. 1 and 2 encloses with its upper part the separator chamber 2 and forms in the lower part the pre-separator chamber 3, which is advantageously designed as a cyclone. In the separator chamber 2, a centrifugal system 6, driven by the motor 5 via a transmission 4, is provided. The term "centrifugal-system" is commonly used in the German Sifter (Classifier) Industry, to connote an impeller wheel or fan wheel. The purpose of the centrifugal-system which will be designated in the claims as "impeller" it to increase the whirling motion of the rising sifter air, in order to increase or maintain the centrifugal forces of the heavier particles suspended in the air, so that these particles can be thrown to the outside and slide down along the outer wall of the separator chamber. The input or feed material is fed to the pre-separator chamber 3 via the separator input 7 and a distributor 8, which is arranged in the form of staggered baffles in the compressed-air line 9 of the blower 10. The compressed air line 9 opens tangentially into the funnel-shaped pre-separator chamber 3, so that the latter acts like a cyclone. The coarse particles of the input material are immediately separated-out in the pre-separator chamber 3 by the centrifugal and gravity forces.

The fine material (dust) which also contains some coarse material but is appreciably smaller in quantity than the input material, is fed to the separator chamber 2 by the air stream generated by the blower 10. In this chamber 2, the separation proper takes place by means of the variable-speed centrifugal system 6 which aids in further separating the coarse matter from the fine material by throwing the heavier particles to the outside. Separated coarse matter drops down through the open bottom of separator chamber 2. The sifted fine material suspended in air is fed from separator chamber 2 to the separator cyclones 12 via the connecting lines 11. The fine material separated there leaves the cyclones 12 at the bottom at 13 via a conventional swinging vane not shown in the drawing. The sifting air is returned from cyclones 12 to the blower 10 via the connecting line 14.

A post-separator chamber 15 is arranged in the lower part of the pre-separator chamber 3 to receive the coarse matter from chamber 3. The air fed-in into chamber 15 flows through the air line 16 and the rate of flow can be controlled with the damper 17. The guiding vanes 18 are provided for uniformly distributing the air entering chamber 15 and as the air passes in contact with the coarse matter therein stripping of the fine material is effected. The coarse matter leaves the separator via the outlet 19. Fresh air or also hot gases can be fed to the separator through the stubs 20 and 21. The exhaust air is fed to a filter, not shown, via the outlet 22 for removal of any solids in the air before discharge into the atmosphere.

Figure 3:
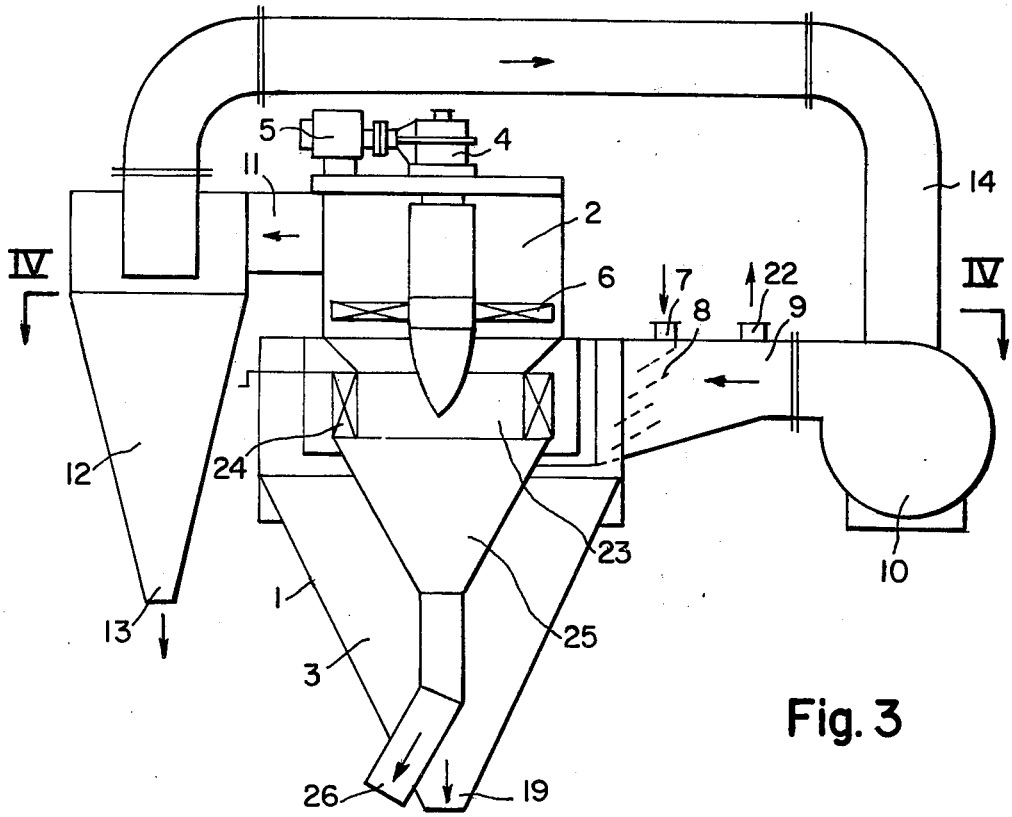
FIG. 3 is an elevational view of a modified circulating air classifier in accordance with the present invention taken along the line III—III of FIG. 4 in the direction of the arrows.
Figure 4:
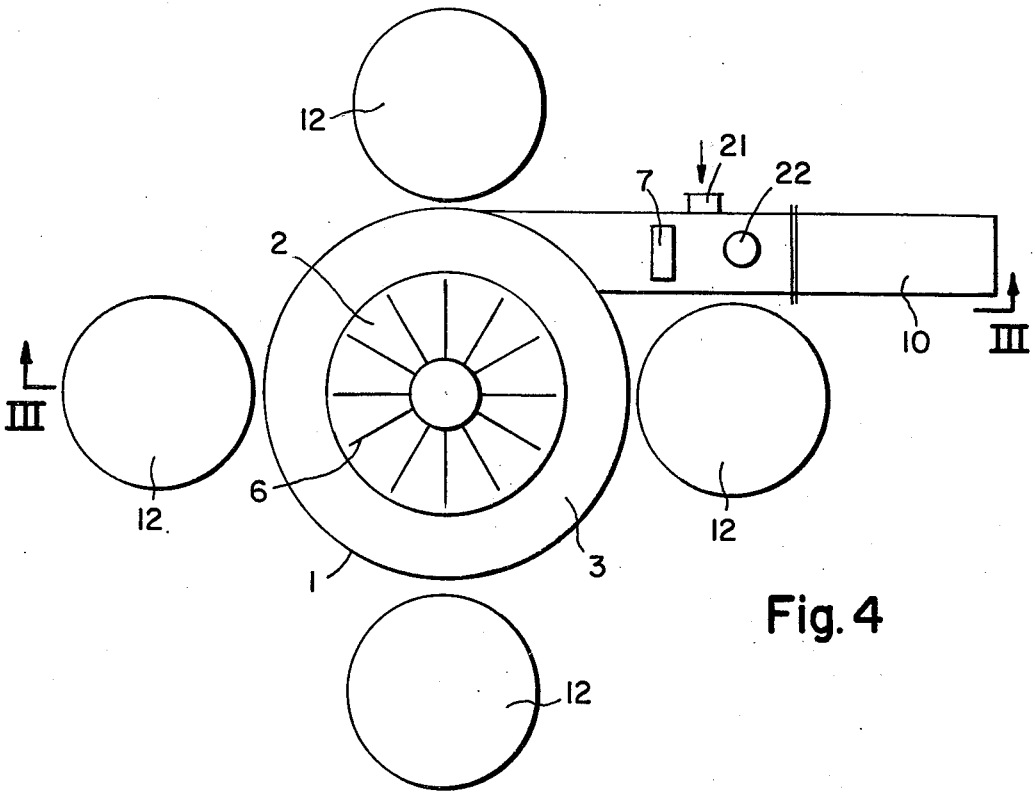
FIG. 4 is a top view of FIG. 3 taken along the line IV—IV of FIG. 3.

In the embodiment of the separator according to FIGS. 3 and 4, a further separator chamber 23 with guide vanes 24 which can be set from the outside to tangentially direct the sifting air and solids into chamber 23, is provided in the pre-separator chamber 3. Thereby, further preliminary sifting takes place in chamber 23 with some separation of the coarse matter. This coarse matter as well as the coarser material which is separated-out by post-separation in the separator chamber 2 leaves the separator via the collecting funnel 25 and the line 26.

There are claimed:

1. Circulating air classifier with vertical axis having a separator chamber in which coarse matter is separated from fine material, an impeller rotatable about the vertical axis disposed in the separator chamber to aid in separating the coarse matter from the fine material suspended in air rising up through the separator chamber, an opening in the bottom of the separator chamber through which the coarse matter discharges, at least another opening in the separator chamber above the bottom through which the fine material suspended in air is discharged, at least one cyclone for receiving said fine material suspended in air and separating the fine material from the air, connecting means for conducting the fine material suspended in air from the opening in the separator chamber to the cyclone, an air blower with an air suction inlet and a pressure discharge outlet, an air return line connecting the cyclone to the suction inlet for recirculating air separated in the cyclone, the improvement comprising (A) a funnel-shaped pre-separator chamber disposed underneath and in open communication with the separator chamber which latter extends downwardly thereby directing any air and suspended matter from the pre-separator chamber upwardly through said rotatable impeller in the separator chamber, (B) a compressed air-line with one end connected to the pressure discharge outlet of the air blower and the other end opening into the upper part of the funnel-shaped pre-separator with air from the air-line flowing tangentially into the pre-separator, (C) inlet means in the compressed air-line upstream from the funnel-shaped pre-separator for the introduction of feed matter, which together with air flowing from the air blower enters the pre-separator tangentially causing coarse matter to be separated from the feed matter, said air and feed matter after separation of coarse matter passing upwardly through the separator chamber to said cyclone for separating the fine material from the air, and (D) outlet means in the lower part of the pre-separator for the discharge of the coarse matter.

2. Circulating air classifier according to claim 1, wherein distributor means are disposed in the compressed air-line in the path of said feed matter to effect more uniform distribution of the feed matter in the air flowing through the compressed air-line.

3. Circulating air classifier according to claim 1, wherein a post-separator chamber is disposed underneath the funnel-shaped pre-separator to receive the coarse matter leaving the pre-separator, and wherein a branch line from the compressed air line supplies air to the post-separator chamber to effect removal of fine material contained in the coarse matter entering the post-separator chamber.

4. Circulating air classifier according to claim 1, including a second, smaller funnel-shaped chamber disposed within the first funnel-shaped chamber and beneath the separator chamber to receive the coarse matter which discharges through the bottom of the separator chamber and which second funnel-shaped chamber has a discharge outlet separate from the outlet means of the first funnel-shaped chamber for the discharge of coarse matter entering the second chamber.

* * * * *